United States Patent [19]

Schneider et al.

[11] Patent Number: 4,610,445

[45] Date of Patent: Sep. 9, 1986

[54] INTEGRATED PRINTER AND TRAY PAPER FEEDING APPARATUS

[75] Inventors: Helmut A. Schneider, Clifton; Dominick Fazio, Whippany, both of N.J.

[73] Assignee: Ziyad Incorporated, Denville, N.J.

[21] Appl. No.: 534,133

[22] Filed: Sep. 20, 1983

[51] Int. Cl.[4] ..... B65H 1/12

[52] U.S. Cl. ..... 271/160; 271/127; 271/164; 271/171

[58] Field of Search ..... 271/127, 126, 171, 162, 271/164, 170

[56] References Cited

U.S. PATENT DOCUMENTS

| | | | |
|---|---|---|---|
| 3,873,196 | 3/1975 | Ogawa | 271/170 X |
| 4,032,136 | 6/1977 | Komaba et al. | 271/171 X |
| 4,032,137 | 6/1977 | Katayama et al. | 271/164 |
| 4,219,192 | 8/1980 | Burke | 271/127 X |
| 4,275,969 | 6/1981 | Matsuhisa et al. | 271/164 X |
| 4,307,878 | 12/1981 | Kono | 271/127 X |
| 4,326,815 | 4/1982 | Kapp | 271/4 X |

*Primary Examiner*—Bruce H. Stoner, Jr.
*Assistant Examiner*—Lawrence J. Goffney, Jr.
*Attorney, Agent, or Firm*—Lerner, David, Littenberg, Krumholz & Mentlik

[57] ABSTRACT

There is illustrated and described a printing device having an integrated paper feeding apparatus adapted for supplying individual sheets of paper to the printing device to effect printing thereon. The integrated printer and paper feeding apparatus of the present invention is particularly suitable for use in word processing systems where the information to be printed in hard copy is contained in a memory device such as a floppy disk or the like. The apparatus may be directly linked to word processing equipment to receive the text of material to be printed. In addition to having the capability of automatically feeding individual sheets of paper from one or more paper trays to the printing device, the apparatus includes an automatic envelope supply mechanism for supplying individual envelopes to the printing device, as well as a manual paper feed option. After effecting printing on the paper or envelope, an ejector mechanism ejects the printed paper from the apparatus and into a receptacle in collated form. All components of the apparatus are enclosed in a single housing having suitable sound reducing material provided to reduce the operational noise of the apparatus. The housing is provided with openings to receive the paper trays and an envelope tray, as well as a top liftable cover designed to provide easy access to the components of the apparatus within the housing.

22 Claims, 19 Drawing Figures

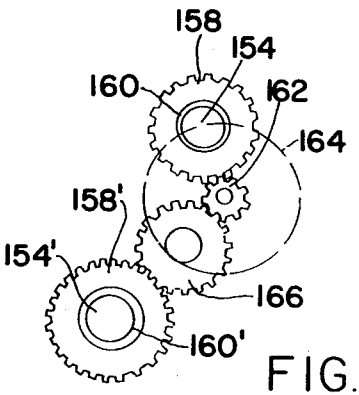
FIG. 7
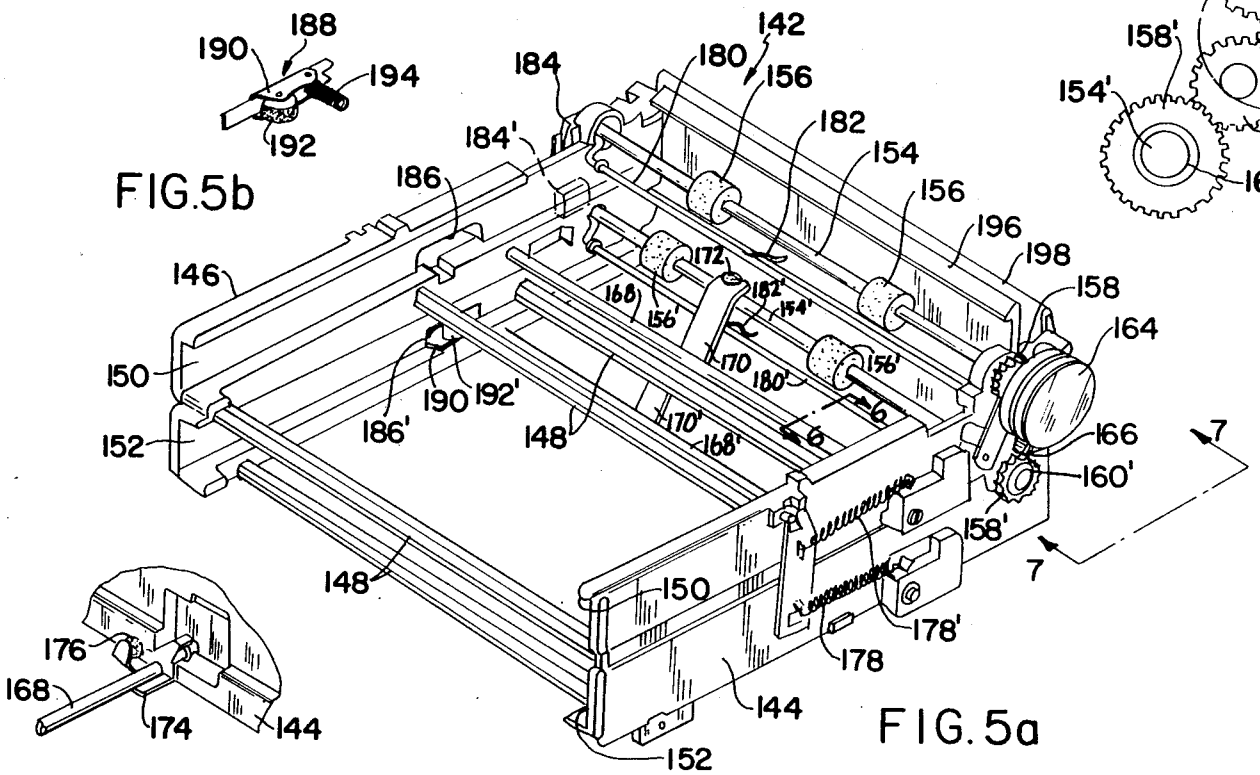
FIG. 5a
FIG. 5b
FIG. 6

INTEGRATED PRINTER AND TRAY PAPER FEEDING APPARATUS

BACKGROUND OF THE INVENTION

The present invention relates in general to a hard copy printing device suitable for use in conjunction with word processing machines and, more particularly, to an integrated printer and tray paper feeding apparatus which will continuously feed individual sheets of paper and envelopes from an internal supply thereof along a feed path past an integrated printing device to effect printing thereon. The paper is arranged in a stack within a paper tray having means which facilitate the insertion and removal of the paper tray from within the apparatus.

Tremendous advances have been made in the last few years in automating office procedures. Conventional typewriters have grown into mini-computers performing word processing, storage and other functions. The speed at which these machines produce words on paper is increasing at a rapid rate. As added speed and sophistication are developed into such machines, the actual putting of words onto paper becomes auxiliary to the main function of collecting and organizing the information into a format to be printed. In order to have flexibility and speed, many systems have been developed where an operator manipulates words on a cathode ray tube or other word processing equipment until the final copy is in the format desired. With all of these advances, it has developed that today one of the major bottlenecks in terms of time, and therefore usefulness of this equipment, is the rate at which paper can be brought to and moved past a printing head to produce the final hard copy.

Of course, it is possible to use continuous sheets of perforated paper, as is commonly done in computer applications, having sprocket holes along the sides thereof to continuously feed and move the paper through an impact printer. This, however, requires special paper which is not suitable to the many requirements for which normal typewriting is employed.

Many machines exist, both copying machines and printing machines, which automatically feed paper past a printing or reproducing station. These machines are normally run synchronously such that prior to the time that paper is fed, the information to be imparted to the paper is already organized and the paper is moved past the printing head in a continuous fashion. This is not generally suitable for impact printing devices since impact printing is accomplished with the paper stationary rather than moving, and further the adaption of normal typewriting type printing requires the moving of paper not only on an intermittent basis, but also in the forward and reverse direction in accordance with the information to be typed. Still further, with such existing equipment, it is generally not possible to manually feed separate sheets of paper, which may be of a different size or thickness, such as, for example, envelopes, without disconnecting the equipment from the printing apparatus.

In U.S. Pat. No. 4,326,815, which patent is assigned to the same assignee of the present invention, there is disclosed a paper feeding apparatus including a removable paper tray which is capable of being retrofitted with respect to existing printing devices, i.e., distributed as an aftermarket product, as well as being capable of being sold and distributed with the printing device. The retrofit characteristic of this paper feeding apparatus lends itself to conform to the requirements of existing impact printing devices rather than requiring the radical modification thereof so as to conform with the needs of high-speed paper feeding. However, although such paper feeding apparatus has been commercially successful, the retrofit nature of the paper feeding apparatus requires separate installation procedures, separate maintenance to both the paper feeding apparatus and the paper printing device, additional office space to accommodate the retrofitted paper feeding apparatus and, often requires a separate and special sound-proofing enclosure to reduce the noise level resulting from the operation of both the paper feeding and paper printing device. Further, the paper tray of the retrofit apparatus requires the manipulation of a lever before the paper tray can be withdrawn from the apparatus. Unless the lever is manipulated, any attempt to withdraw the paper tray could result in damage to the apparatus. There is therefore a further need for a paper tray which can be inserted and withdrawn from an integrated printer and paper feeding apparatus which will prevent any inadvertent damage thereto.

SUMMARY OF THE INVENTION

It is broadly an object of the present invention to provide an integrated printer and tray paper feeding apparatus which overcomes or avoids one or more of the foregoing limitations resulting from the use of the above-mentioned prior art retrofitted paper feeding apparatus having a paper tray and, which fulfills the specific requirements of such an integrated printer and paper feeding apparatus for use with modern-day computers and high-speed word processing equipment and, which facilitates the insertion and removal of the paper tray from the apparatus. Specifically, it is within the contemplation of one aspect of the present invention to provide a paper loading assembly for a printing device, the printing device including paper advancing means for advancing a sheet of paper within the printing device, the paper loading assembly comprising paper storing means for storing a plurality of individual sheets of paper and having first and second cam surfaces, paper feeding means for feeding individual sheets of paper from the paper storing means along a paper feed path to the paper advancing means, engaging means movable between an operative and inoperative position for engaging the paper storing means when in the operative position so as to position the plurality of individual sheets of paper within the paper storing means into position for feeding by the paper feeding means and, cam follower means for moving the engaging means between the operative and inoperative positions when the cam follower means engages the first and second cam surfaces of the paper storing means, the first and second cam surfaces and the cam follower means being arranged so that the cam follower means engages the first cam surface upon insertion of the paper storing means within the printing device to move the engaging means toward the inoperative position and then engages the second cam surface upon further insertion of the paper storing means within the printing device to move the engaging means toward the operative position into engagement with the paper storing means.

In accordance with another aspect of the present invention, there is provided a printing device comprising, paper advancing means for advancing a sheet of paper along a paper feed path within the printing device, printing means for printing on a sheet of paper being advanced along the paper feed path by the paper advancing means and a paper loading assembly including paper storing means for storing a plurality of individual sheets of paper and having first and second cam surfaces, paper feeding means for feeding individual sheets of paper from the paper storing means along the paper feed path to the paper advancing means, engaging means movable between an operative and inoperative position for engaging the paper storing means when in the operative position so as to position the plurality of individual sheets of paper within the paper storing means into position for feeding by the paper feeding means and, cam follower means for moving the engaging means between the operative and inoperative positions when the cam follower means engages the first and second cam surfaces of the paper storing means, the first and second cam surfaces and the cam follower means being arranged so that the cam follower means engages the first cam surface upon insertion of the paper storing means within the printing device to move the engaging means toward the inoperative position and then engages the second cam surface upon further insertion of the paper storing means within the printing device to move the engaging means toward the operative position into engagement with the paper storing means.

BRIEF DESCRIPTION OF THE DRAWINGS

The above description, as well as further objects, features and advantages of the present invention will be more fully understood by reference to the following detailed description of the presently preferred but nonetheless illustrative integrated printer and tray paper feeding apparatus in accordance with the present invention when taken in conjunction with the accompanying drawings, wherein:

FIG. 5*a* and 5*b* are perspective view of the paper loading assembly in accordance with the present invention showing various components thereof;

FIG. 6 is a perspective view taken along lines 6—6 of FIG. 5*a* showing the cam follower means of the paper loading asembly;

FIG. 7 is a side elevational view taken along lines 7—7 of FIG. 5*a* showing the one-way clutch gear arrangement of the paper loading assembly;

DETAILED DESCRIPTION OF THE PREFERRED EMBODIMENT

Figure 1:
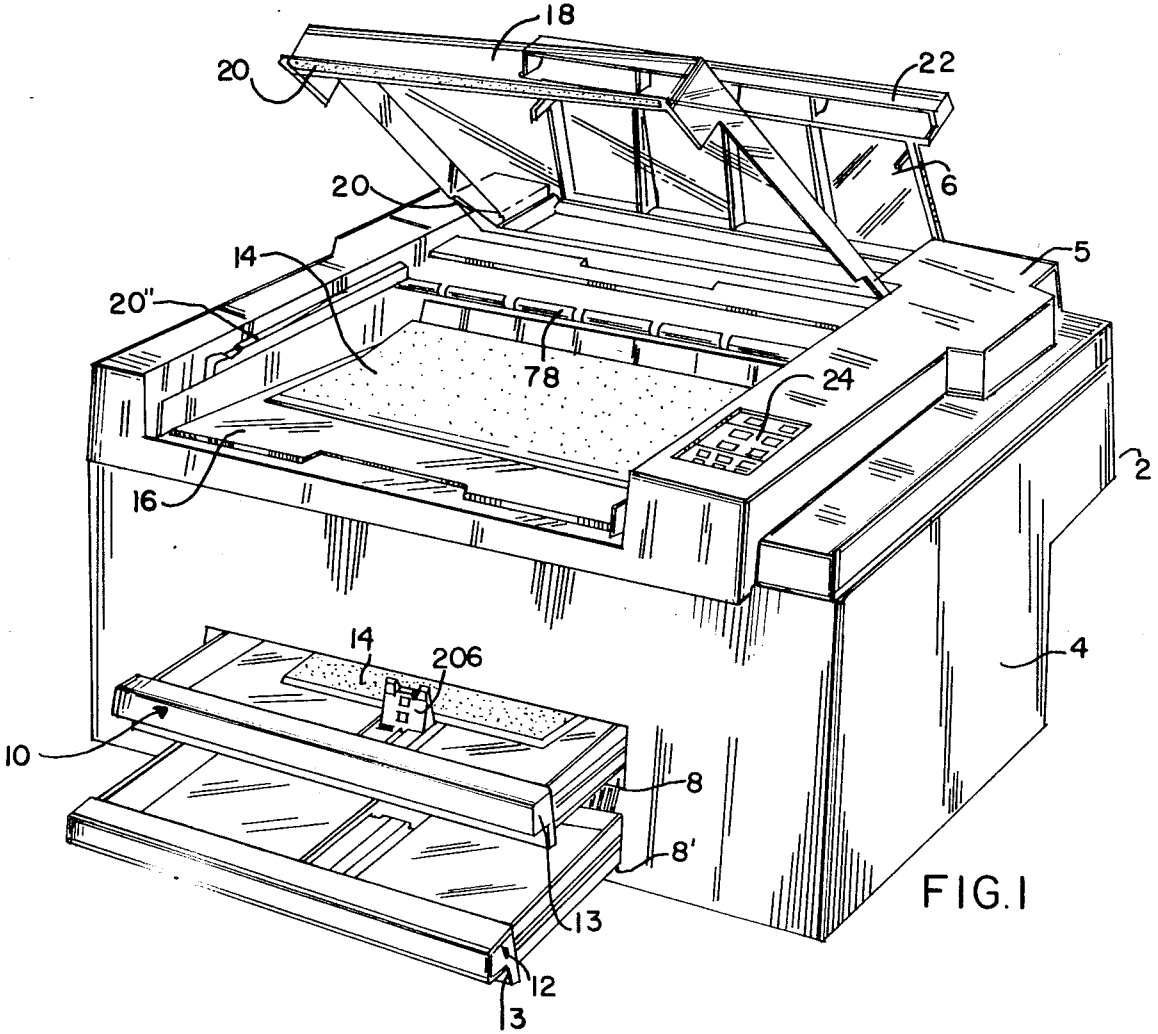
FIG. 1 is a perspective view of the integrated printer and paper feeding apparatus in accordance with the present invention showing a sound reducing housing including a pair of paper trays, a paper stacking tray arranged underlying a sound reducing cover, an envelope compartment cover and a control panel.
Figure 2:
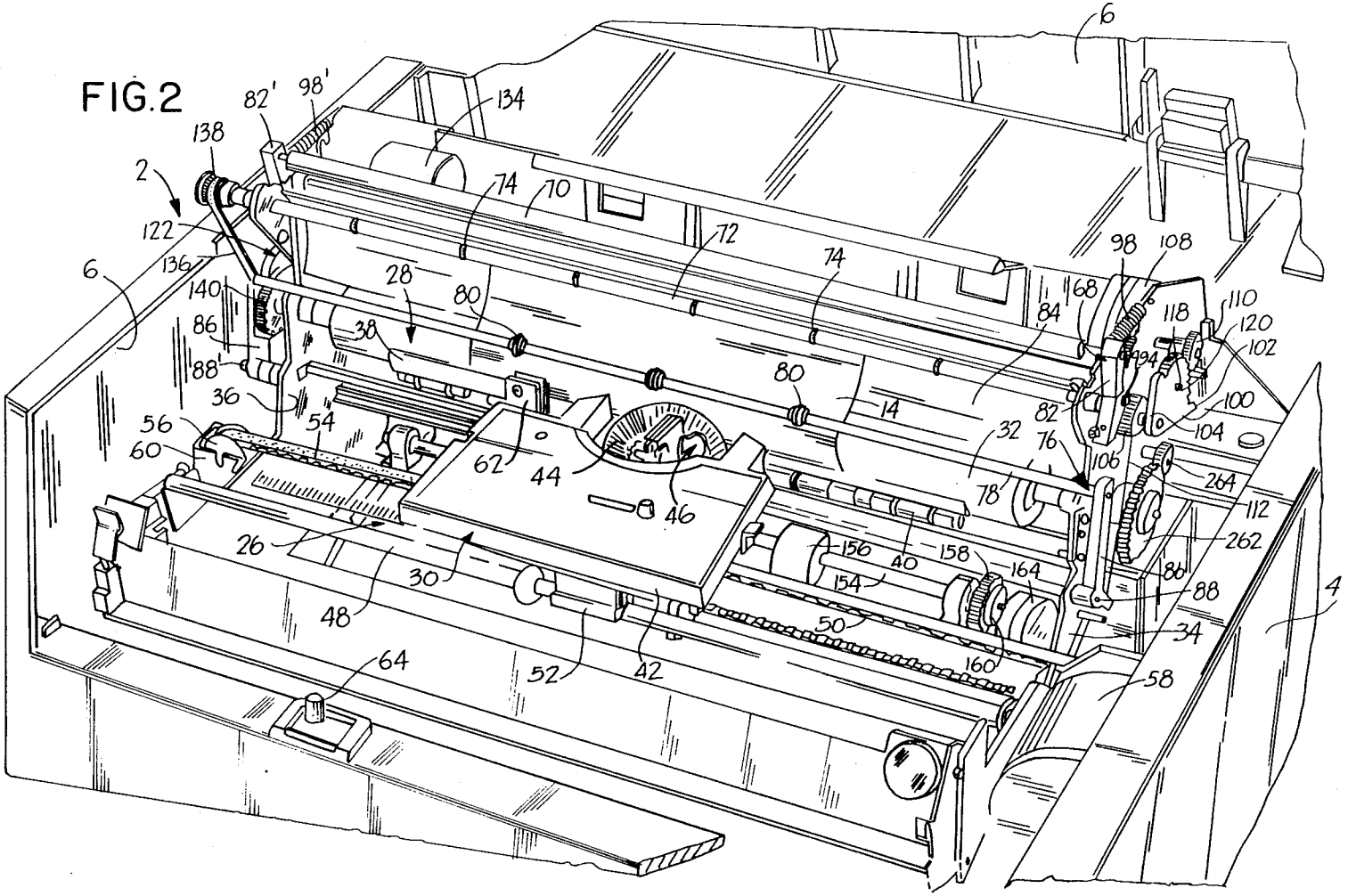
FIG. 2 is a perspective view of the integrated printer and paper feeding apparatus of FIG. 1 with a top portion of the sound reducing housing, including the paper stacking tray and sound reducing cover, removed to show various components thereof.

Referring now to the drawings wherein like reference characters represent like elements, there will now be described the construction and operation of an integrated printer and paper feeding apparatus in accordance with the present invention. Specifically referring to FIG. 1, there is illustrated an integrated printer and paper feeding apparatus constructed in accordance with the preferred embodiment and generally designated by reference character 2. The integrated printer and paper feeding apparatus 2 is constructed from a sound reducing housing 4 having a top cover 5 and sound reducing material 6 lining the inside walls thereof, as generally shown in FIG. 2. One such material suitable for reducing the noise level produced as a result of the operation of the integrated printer and paper feeding apparatus 2 is urethane cellular acoustical foam; however, other such materials may also be used in accordance with the present invention. Arranged on the face of the housing 4 are a pair of adjacent rectangular openings 8, 8' for receiving a pair of paper trays 10, 12 provided for storing a first and second plurality of individual sheets of paper 14 for printing thereon. The paper trays 10, 12 are provided with closures 13 to close the openings 8, 8' when the paper trays are inserted into the housing 4. The paper trays 10, 12 may also be provided with suitable sound reducing material (not shown) to assist in elimination of noise from operation of the apparatus 2, in particular, provided as a seal around the closures 13 to engage the surface of the housing 4. A paper stacking tray 16 is removably provided within the top cover 5 of the housing 4 for receiving in collated arrangement individual sheets of paper 14 having printing thereon upon being ejected from the integrated printer and paper feeding apparatus 2.

A sound reducing cover 18 is provided overlying the paper stacking tray 16. In addition to protecting the collated printed paper 14 within the paper stacking tray 16, the sound reducing cover 18 functions to reduce the noise produced by the operation of the integrated printer and paper feeding apparatus 2. In this regard, the sound reducing cover 18 is removably sealed to the top cover 5 of the housing 4 by strips of rubber like gasket material 20, 20' arranged along the edges of the sound reducing cover and the provision of a similar rubber strip 20'' arranged adjacent the paper stacking tray 16 within the top cover for sealing engagement with the side edges of the sound reducing cover. Located behind the cover 18 is an envelope compartment cover 22 for providing access to a stack of individual envelopes to be supplied to the integrated printer and paper feeding apparatus 2. As shown, the envelope compartment cover 22 is provided with sound reducing material 6 on its inside surface to reduce the noise resulting from the operation of the integrated printer and paper feeding apparatus 2. The user operation of the integrated printer and paper feeding apparatus 2 is controlled through the control panel 24 mounted in a convenient location to the top cover 5 of the housing 4. Thus, it can be appreciated that the sound reducing housing 4 of the integrated printer and paper feeding apparatus 2, in addition to being compact, occupying a minimum of space and being of pleasing design, significantly reduces the noise level attributable to the operation of the integrated printer and paper feeding apparatus while providing easy access to the components thereof through the top cover 5. These and other attributes of the present invention will be readily appreciated to those having ordinary skill in the art in consideration of the following further detailed description of the construction and operation of an integrated printer and paper feeding apparatus 2 in accordance with the present invention.

Figure 14:
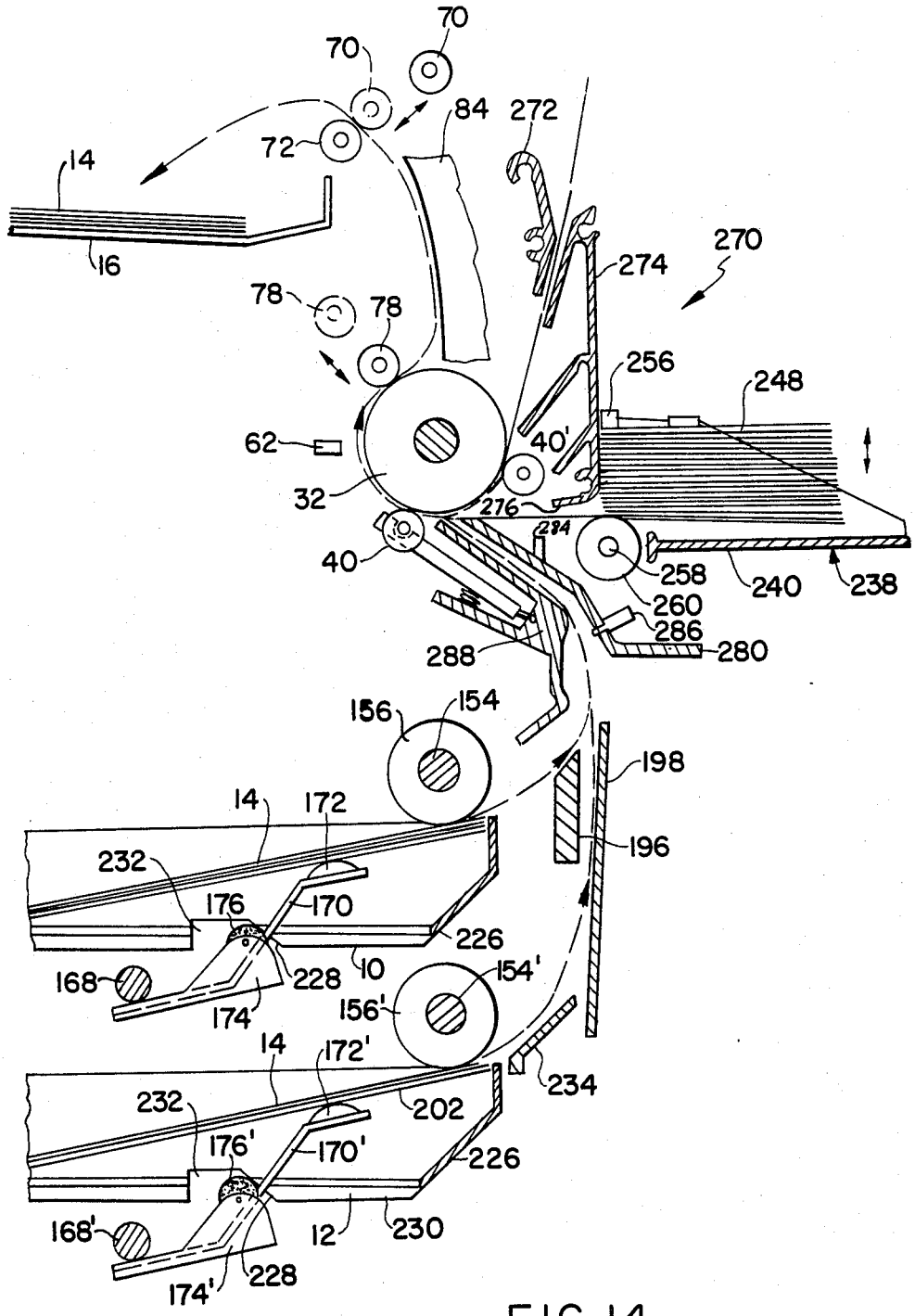

Referring now to FIG. 2, the integrated printer and paper feeding apparatus 2 includes a printing device generally designated by reference character 26. The printing device 26 is constructed from a platen assembly 28 which is adapted to advance a sheet of paper 14 within the integrated printer and paper feeding apparatus 2 and a print head carriage assembly 30 which is adapted to traverse back and forth across the transverse length of the platen assembly 28 to effect printing on the paper. The platen assembly 28 is constructed from a rotatable platen 32 transversely extending between a pair of side plates 34, 36 and which is adapted to rotate about a transversely extending axis. A paper guide 38 is arranged adjacent to and extending along a substantial portion of the longitudinal extent of the platen 32 for guiding a sheet of paper 14 from a paper feed path upwardly around the platen. A plurality of spaced apart pressure rollers 40 are supported by paper guide plate 288 in engagement with the platen 32 along a lower front portion as shown in FIG. 2 and FIG. 14. A second plurality of spaced apart pressure rollers 40' (see FIG. 14) are provided along a middle rear portion of the platen 32 for manual feeding of sheets of paper as more fully described hereinbelow. As shown in FIG. 2, a sheet of paper 14 to be printed on is received between the platen 32 and the paper guide 38 and is advanced in a forward and a reverse direction by rotation of the platen and engagement with the pressure rollers 40.

The print head carriage assembly 30 is constructed of a ribbon cartridge 42 for storage of a printing ribbon, a character print wheel 44, a print wheel retainer 46 for removably securing the print wheel to the print head carriage assembly 30, and a print wheel motor and encoder (not shown). The ribbon cartridge 42, print wheel 44 and print wheel retainer 46 may be of conventional construction and accordingly the details of such construction will not be described herein. The print head carriage assembly 30 is movably mounted adjacent the platen 32 to a pair of parallel spaced apart transversely extending carriage rails 48, 50 by means of, for example, a pair of slide bushings 52 of which only the forwardmost slide bushing is shown. The print head carriage assembly 30 is secured to the ends of a belt 54 which extends longitudinally between carriage rails 48, 50. The belt in turn engages an idler pulley 56 and a drive pulley (not shown). As shown in FIG. 2, the idler pulley 56 is arranged at the leftmost end of the apparatus 2 where it is secured by bracket 60 to the side plate 36. The drive pulley is at the rightmost end of the apparatus 2 and engages a carriage drive motor 58.

As thus far described, the print wheel 44 is carried by the movable print head carriage assembly 30 which traverses across the transverse extent of the platen 32 by means of the carriage drive motor 58. The print wheel 44 is arranged to be closely spaced from the platen 32 so that printing in lines can be achieved on the paper 14 as the print carriage assembly 30 traverses between the ends of the platen. Alternatively, the platen 32 could be carried by a carriage and moved transversely past the print wheel 44. During the printing operation, the platen 32 serves to rotate intermittently about its transverse axis to advance the sheet of paper 14 longitudinally relative to the print wheel 44 for the printing of the next line thereon by virtue of the transverse movement of the print wheel with respect thereto. In the operation of the printing device 26 as thus far described and shown in FIG. 2, printing is accomplished by transversely moving the print carriage assembly 30 relative to the paper 14 and then advancing the paper longitudinally by rotation of the platen 32 and engagement of the pressure rollers 40 to permit the print carriage assembly to effect the next line of printing. This printing operation may be as in a conventional typewriter from left to right, or the printing may be from left to right for one line of print with the next line of print being effected by movement of the print carriage assembly 30 from right to left. This latter means of printing is commonly used in many present-day word processing systems.

The integrated printer and paper feeding apparatus 2 in accordance with the present invention is mainly designed for use where the printing device 26 is of the type having automatic printing or typing capabilities, i.e., printing systems or devices in which a complete page of print is effected automatically without or with a minimal amount of instructions from the user. In such systems, the text of the matter to be printed may have been previously stored on a disk or similar recording device, or may be in the memory of a cathode ray tube on which a user has arranged the matter or information in a desired format. When desired, the system simply prints the stored information onto sheets of paper in a continuous manner.

Generally, in the printing operation, the matter or information is printed one line at a time, with the paper 14 then being automatically advanced for effecting printing on the next line, and so on until an entire page is printed. Such printing devices 26 are generally of impact printing type, i.e., a hammer impacts the print wheel which in turn impacts the paper 14 against the platen 32 to effect the printing. However, it should be appreciated that the integrated printer and paper feeding apparatus 2 in accordance with the present invention could also be used with other types of printing devices 26, such as, for example, ink jet printers, matrix printers, direct thermal printers, thermal transfer printers, laser printers, line printers, and/or non-impact electricalstatic printers. Further in accordance with the present invention, the print head carriage assembly is provided with a sensor 62, whose function is to be more fully described hereinafter and the housing 4 is provided with a panel switch 64 which functions as a lock-out switch to shut off the power to the integrated printer and paper heading apparatus 2 when the stacking tray 16 on the top cover 5 is lifted, for example, to effect repair and maintenance.

Figure 3:
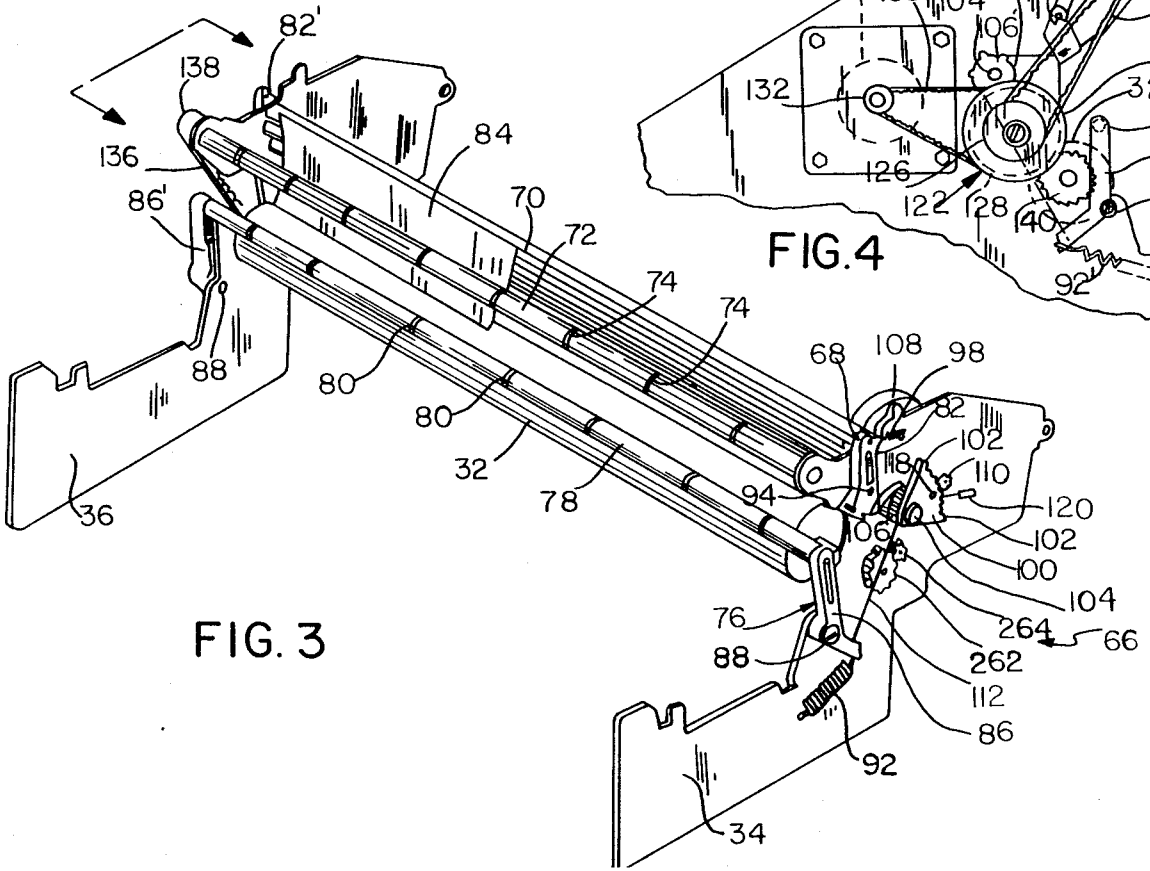
FIG. 3 is a perspective view showing the paper gripping mechanism in accordance with the present invention including paper advancing means for advancing a sheet of paper within the apparatus and paper ejecting means for ejecting a sheet of paper from within the apparatus.

Referring now to FIG. 3, there will be described the paper gripping mechanism 66 in accordance with the integrated printer and paper feeding apparatus 2 of the present invention. The paper gripping mechanism 66 includes a paper ejecting assembly generally designated by reference character 68 for ejecting a sheet of paper 14 from the printing device 26 after printing has been effected thereon. In the preferred embodiment, the paper ejecting assembly 68 is constructed from a pair of spaced apart ejector rollers 70, 72 which are supported rearwardly of the integrated printer and paper feeding apparatus 2 between the side plates 34, 36 and arranged so as to receive therebetween a sheet of paper 14 as it exits from the printing device 26 along a paper exit path. As best shown in FIG. 2, the sheet of paper 14 is guided between the spaced apart ejector rollers 70, 72 while printing is being effected thereon, the spacing of the ejector rollers serving to allow the paper 14 to move freely under the control of the platen 32. When it is desired to eject a sheet of paper 14 after the printing has been completed, or otherwise, the rear ejector roller 70 is moved towards the forward stationary ejector roller 72 to grippingly engage a sheet of paper 14 therebetween. The stationary ejector roller 72 being continuously rotated is operative by means of a plurality of equally spaced O-rings 74 to pull the sheet of paper 14 upwardly along the paper exit path and away from the printing device 26 and to stack same in collated form within the paper stacking tray 16, as shown in FIG. 1.

Likewise, the paper gripping mechanism 66 includes a platen paper gripping assembly 76 constructed of a paper bail 78 supported forward of the platen 32 between the side plates 34, 36 and movably arranged between a closed position in contact with the platen 32 and an open position spaced adjacent the platen 32 so as to receive a sheet of paper 14 therebetween. In this regard, the paper bail 78 is normally in engagement with the platen 32 by means of a plurality of equally spaced O-rings 80 or the like. As best shown in FIG. 2, a sheet of paper 14 is guided between the platen 32 and the paper bail 78 while printing is being effected thereon by the printing device 26. The engagement of the paper bail 78 with the platen 32 generally serves to allow the paper 14 to be moved smoothly under the control of the platen so as to effect a uniform and precise printing on the paper 14 by maintaining the paper in contact with the platen at the location where the printing on the paper occurs. When it is desired to insert a new sheet of paper 14 after the printing has been completed and the previous sheet ejected by the paper ejecting assembly 68, the paper bail 78 is moved away from the platen 32 to allow the paper 14 to move freely under the control of the platen into its position in alignment with the printing device 26. Once the sheet of paper 14 has been advanced by the platen 32 into operative alignment with the printing device 26, the paper bail 78 is moved into engagement therewith prior to the printing operation.

More particularly, with reference to the paper ejecting assembly 68, the ejector rollers 70, 72 are transversely mounted between the side plates 34, 36 overlying the platen 32 along either side of a paper exit path as more clearly shown in FIG. 14. Stationary ejector roller 72 is rotationally mounted between the side plates 34, 36 forward of the paper exit path. On the other hand, ejector roller 70 is mounted to the rear of the paper exit path between a pair of ejector arms 82, 82' to allow pivotal movement of the ejector roller 70 into engagement with the stationary ejector roller 72 for engaging a sheet of paper 14 therebetween and ejecting same from the printing device 26 and into the paper stacking tray 16. Arranged along the paper exit path is provided a concaved exit guide plate 84 arranged to lie just above the rotatable platen 32 adjacent the exit end thereof and extending upwardly along the paper exit path to just below the point of engagement between the ejector rollers 70, 72 for guiding a sheet of paper 14 from the printing device 26 along the paper exit path and between the ejector rollers for engagement therewith.

Figures 13A, 13B, 13C:
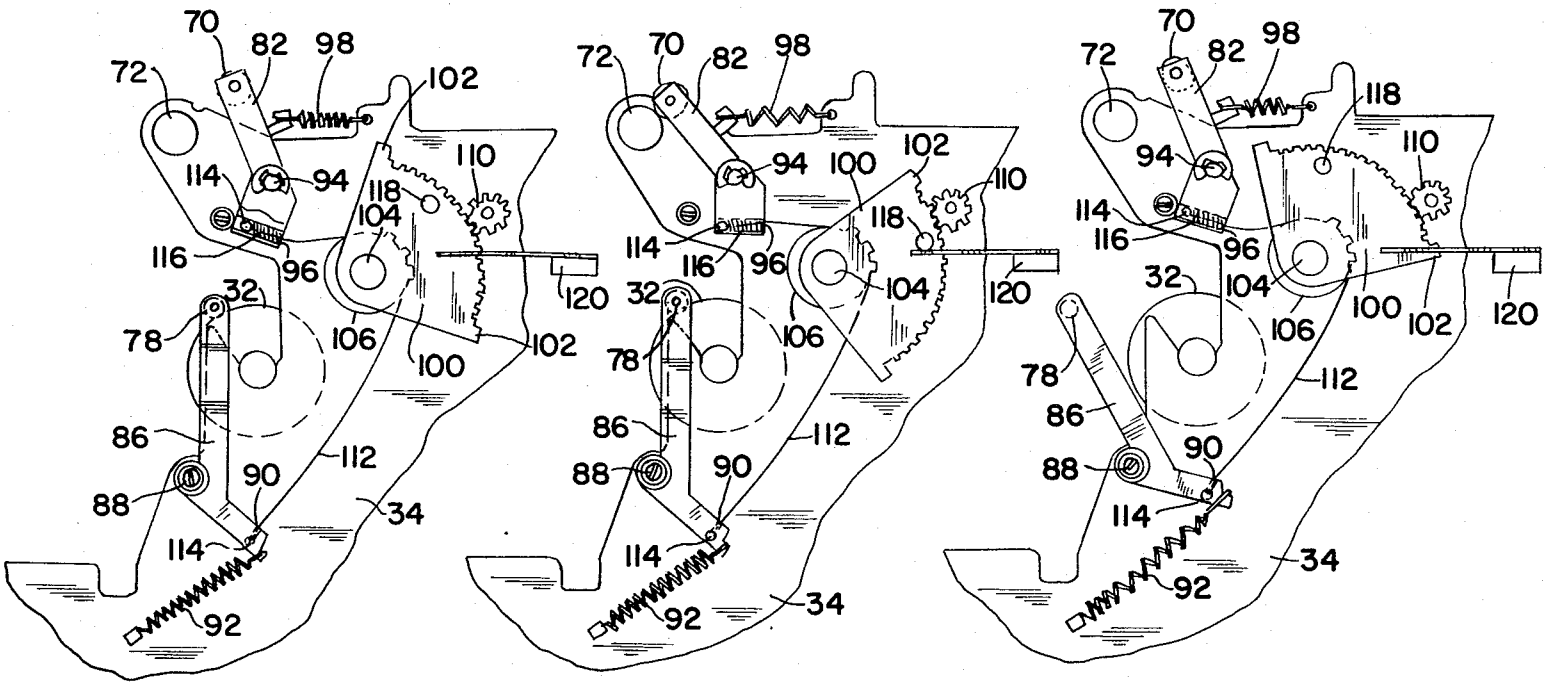
FIGS. 13*a* through 13*c* are side elevational views showing the three operative positions of the control means for the paper gripping mechanism as shown in the lower right-hand corner of FIG. 3; and, FIG. 14 is a schematic side elevational view of the integrated printer and paper feeding apparatus in accordance with the present invention showing the various paper feed and exit paths for sheet of paper and envelopes within the apparatus.

More particularly, as to the platen paper gripping assembly 76, the paper bail 78 is transversely mounted overlying a forward portion of the platen 32 between a pair of platen arms 86, 86'. As best shown in FIG. 3 and FIGS. 13*a*–13*c*, the platen arms 86, 86' are pivotally attached about pivot points 88, 88' to the side plates 34, 36 underlying the forward portion of the platen 32. The paper bail 78 is transversely mounted between the upper ends of the platen arms 86, 86' while the lower ends are provided with an opening 90. Springs 92, 92' are attached to the lower ends of the platen arms 86, 86' to normally bias the paper bail 78 into engagement with the platen 32, as best shown in FIGS. 13*a* and 13*b*. Likewise, the ejector arms 82, 82' are pivotally mounted to the side plates 34, 36 to pivot about pivot points 94, 94' which are above the rotational axis of the platen 32. The ejector roller 70 is transversely mounted between the upper ends of the ejector arms 82, 82' while the lower ends of the ejector arms are provided with an opening 96. Springs 98, 98' are secured to the upper portion of the ejector arms 82, 82' for biasing the ejector roller 70 rearward of the paper exit path and out of engagement with the ejector roller 72 to permit the upward feeding of a sheet of paper 14 between the platen 32 and paper bail 78 along the paper exit path.

The paper gripping mechanism 66, namely the paper ejecting assembly 68 and the platen paper gripping assembly 76 is controlled by a sector gear 100 having a plurality of teeth terminating at a pair of stops 102. The sector gear 100 is pivotally mounted to an axle 104, see FIG. 2, extending transversely between the side plates 34, 36 to which a pair of cable pulleys 106, 106' are attached adjacent each side plate. A single motor 108 having a drive gear 110 meshed with the teeth of the sector gear 100 causes rotation of the axle 104 and cable pulleys 106, 106' in either a clockwise or counterclockwise direction depending upon the direction of rotation of the motor. Wire cables 112, 112' are provided having a center portion thereof secured to the cable pulleys 106, 106' and having their terminal ends provided with a retaining member or ball 114 slidably captured within the openings 90, 96 of the platen arms 86, 86' and ejector arms 82, 82' as best shown in FIG. 13*a*. In addition, a spring 116 is provided within the opening 96 of the ejector arms 82, 82' through which the wire cables 112, 112' respectively pass and is arranged to be compressed by the ball 114 in a manner to be described hereinafter. A pin 118 is arranged projecting from the face of the sector gear 100 at a central portion for engagement with the actuating lever of a mechanical microswitch 120. The specific operation of the paper gripping mechanism 66 with respect to the paper ejecting assembly 68 and the platen paper gripping assembly 76 by means of rotation of the sector 100 will now be described.

Referring to FIGS. 13*a* through 13*c*, the operation of the paper gripping mechanism 66 will be described by reference only to its construction as shown adjacent side plate 34. As shown in FIG. 13*a*, the paper bail 78 is normally engaged on the outer surface of the platen 32 while the ejector roller 70 is normally spaced apart from the stationary ejector roller 72. This condition is achieved by the spring 98 biasing the ejector arm 82 away from the stationary ejector roller 72 and the spring 92 biasing the platen arm 86 towards the platen 32 for engagement with the paper bail 78. In addition, this condition is maintained by the drive gear 110 being positioned centrally along the teeth of the sector gear 100 between the stops 102. Upon rotation of the drive gear 110 in a counterclockwise direction as viewed in FIG. 13*a*, the sector gear 100 is rotated in a clockwise direction, a predetermined amount to the position adjacent the upper stop 102 as shown in FIG. 13*b*. As the sector gear 100 is rotated in the clockwise direction, the cable 112 being attached to the cable pulley 106 causes that portion of the cable captured within the opening 96 within the lower end of the ejector arm 82 to rotate the ejector arm in a counterclockwise direction causing the engagement of the ejector roller 70 with the stationary ejector roller 72. The compression spring 116 serves to accommodate any overdrive of the sector gear 100 to prevent damage to the ejector arm 82 or the components thereof. As shown in FIG. 13*b*, as the sector gear 100 is rotated in the clockwise direction, the pin 118 closes the microswitch 120 via the actuating lever which was previously in an open condition as shown in FIG. 13*a*. The function of the microswitch 120 will be described hereinafter.

Referring to FIG. 13*c* as the drive gear 110 is rotated in a clockwise direction, the sector gear 110 is rotated in a counterclockwise direction until the drive gear is positioned adjacent the lower stop 102. In this position, the cable 112 being attached to the cable pulley 106 and having its end captured within the opening 90 at the lower end of the bail arm 86, causes the bail arm to rotate in a counterclockwise direction moving the paper bail 78 away from its previous engagement with the surface of the platen 32. It is to be noted that as the ends of the cable 112 are slidingly encaptured within the openings 90, 96 of the bail arm 86 and ejector arm 82, the rotation of the sector gear 100 in a clockwise direction, although causing the ejector roller 70 to engage the stationary ejector roller 72 by pivotal movement of the ejector arm 82, the bail arm 86 is maintained in its position where the paper bail 78 is in engagement with the platen 32. Likewise, the rotation of the sector gear 100 in a counterclockwise direction to cause pivotal movement of the bail arm 86 in a counterclockwise direction to remove the paper bail 78 from engagement with the platen 32, allows the ejector arm 82 to remain in its position where the ejector roller 70 is spaced from and out of engagement with the stationary ejector roller 72.

Figure 4:
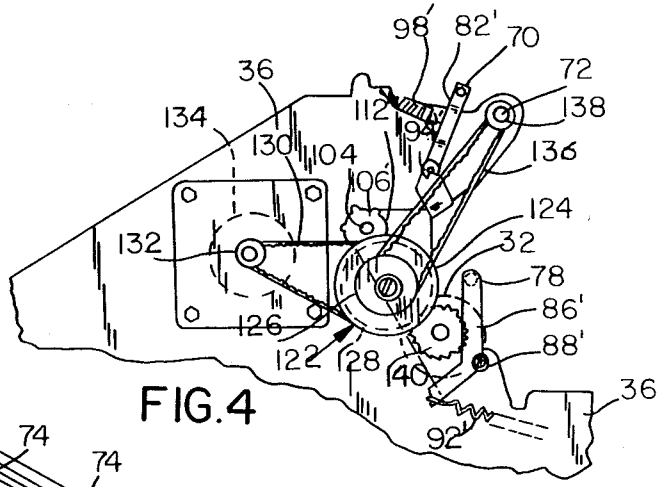
FIG. 4 is a side elevational view taken along lines 4—4 of FIG. 3 and illustrating the platen of FIG. 3 showing the platen idler gear assembly of the present invention adapted for rotation of the platen and paper ejecting means.

Referring to FIG. 4, there will now be described the platen idler gear assembly generally designated by reference character 122. The platen idler gear assembly 122 is constructed of a center gear 124 sandwiched between a forward ejector gear 126 and a rear platen gear 128, shown in dotted lines. The platen idler gear assembly 122 is rotated by a timing belt 130 driven by a pulley 132 connected to a motor 134 as shown in dotted lines, see also FIG. 2. The stationary ejector roller 72 is likewise rotated by a timing belt 136 provided between the forward ejector gear 126 and a pulley 138 secured to the ejector roller adjacent the side plate 36. The platen 32 is driven by the rear platen gear 128 being meshed with a platen drive gear 140 attached at one end thereof adjacent the side plate 36. Thus, it can be appreciated that the controlled operation of the motor 134 is such to cause simultaneous rotation of the platen 32 and the ejector roller 72.

Referring to FIGS. 5*a*, 5*b*, 6 and 7, there will now be described the paper loading assembly generally designated by reference character 142 in accordance with the present invention. The paper loading assembly 142 is constructed from a pair of side frames 144, 146 spaced apart in parallel relationship by means of a plurality of transversely extending rods 148. The side frames 144, 146 are constructed to include pairs of upper and lower inwardly facing U-shaped tracks 150, 152. As will be understood, the side frames 144, 146 are spaced by the rods 148 such that the paper trays 10, 12 can be received and supported within the pairs of tracks 150, 152 of the paper loading assembly 144. The paper loading assembly 142 is adapted to receive the paper tray 10 within the upper pairs of tracks 150, which is identical to the construction of the paper loading assembly for receiving the paper tray 12 within the lower pair of tracks 152. Accordingly, the following description will refer to that portion of the paper loading assembly 142 adapted to receive the paper tray 10 within the pairs of upper tracks 150.

As shown in FIG. 5*a*, spaced above the pair of tracks 150 at the rear end of the side frames 144, 146 there is provided a transversely extending paper feed shaft 154 having a pair of spaced apart rollers 156 secured thereto. The rollers 156 are adapted to engage spaced portions of the upper sheet of paper 14 urged into contact therewith upon insertion of the paper tray 10 between the pair of upper tracks 150 as to be described. That end of the paper feed shaft 154 adjacent the side frame 144 is connected to a gear 158 centrally provided with a one-way roller clutch 160 (see also FIG. 2). As best shown in FIG. 7, the gear 158 is driven by a drive gear 162 connected to a motor 164 operative in a clockwise and counterclockwise direction. Likewise, the lower paper feed shaft 154' is connected to a gear 158' having a one-way roller clutch 160' adapted to be driven by the drive gear 162 by means of an idler gear 166 meshed therebetween. The one-way roller clutches 160, 160' are operative so that the gears 158, 158' will be free rolling relative to the paper feed shafts 154, 154' in one direction, i.e., when the gears 158, 158' rotate in a clockwise direction relative to the paper feed shafts 154, 154' as viewed in FIG. 7 and will be locked with the paper feed shafts 154, 154' in the opposite direction, i.e., the counterclockwise direction relative to the paper feed shafts 154, 154' as viewed in FIG. 7. In this way, when the gears 158, 158' are rotated in the counterclockwise direction by operation of the motor 164, the paper feed shafts 154, 154' and the rollers 156, 156' will be rotated therewith to engage and force a single sheet of paper 14 from a respective paper tray 10, 12 forwardly thereof. On the other hand, when the gears 158, 158' stop rotating and the single sheet of paper 14 is pulled out from one of the paper trays 10, 12, either manually or by operation of the paper ejecting assembly 68, the rollers 156, 156' and paper feed shafts 154, 154' will be free to rotate in the counterclockwise direction. The operation of the motor 164 alternately between a clockwise and counterclockwise direction is operative to feed a sheet of paper 14 respectively from one of the paper trays 10, 12.

Specifically, clockwise rotation of the drive gear 162 by the motor 164 is operative to cause rotation of the gear 158 and roller clutch 160 in a counterclockwise direction causing rotation of the paper feed shaft 154 and rollers 156 in a counterclockwise direction for feeding a single sheet of paper 14 from the paper tray 10. However, the clockwise rotation of the drive gear 162 causes clockwise direction of the gear 158' and roller clutch 160' as a result of the intermeshed idler gear 166. The clockwise direction of the roller clutch 160' allows the paper feed shaft 154' and rollers 156' to remain stationary without rotation thereby enabling the feeding of single sheets of paper 14 from only the paper tray 10. Conversely, the counterclockwise rotation of the drive gear 162 by the motor 164 causes counterclockwise rotation of the gear 158' and roller clutch 160' by the intermeshed idler gear 166. The counterclockwise rotation of the roller clutch 160' causes counterclockwise rotation of the paper feed shaft 154' and rollers 156' to effect feeding of single sheets of paper 14 from the paper tray 12.

However, in a similar manner as previously described, the counterclockwise rotation of the drive gear 162 causes clockwise rotation of the gear 158 and roller clutch 160 such that the paper feed shaft 154 and rollers 156 remain idle. Thus, it can be appreciated that individual sheets of paper 14 can be fed alternatively between the paper trays 10, 12 depending upon the direction of rotation of the drive gear 162 in either a clockwise or counterclockwise direction by operation of the motor 164.

Figure 10A:
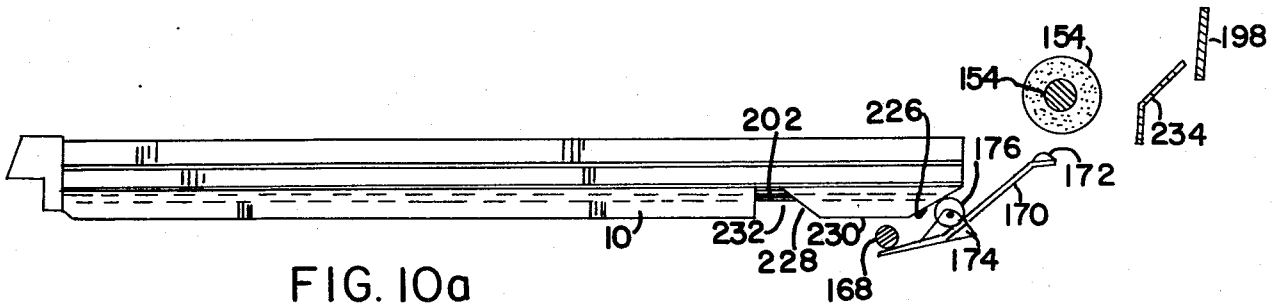
FIGS. 10*a* through 10*c* are side elevational views showing the operative engagement between the paper tray of FIG. 8 within the paper loading assembly of FIG. 5*a;*

Positioned forward of the paper feed shaft 154 and extending transversely between the side frames 144, 146 is a rotatable pressure shaft 168 having a centrally attached upwardly projecting pressure arm 170 terminating at a flat portion having a protrusion 172 thereon. Secured to the end of the pressure shaft 168 adjacent the track 150 of the side frame 144 is a bracket 174 having a cam follower or roller 176 rotatably mounted thereto as best shown in FIG. 6. The roller 176 is mounted for rotation about a horizontal axis rearward of the axis of rotation of the pressure shaft 168. Further, as best shown in FIG. 10*a*, with the pressure shaft 168 in its normal position, the vertical circumferential extent of the roller 176 extends beyond the vertical extent of the pressure shaft 168. The pressure shaft 168 is normally biased in its operative position as shown in FIG. 5*a* by means of spring 178 attached to the bracket 174 and a portion of the side frame 144. Arranged transversely extending between the side frames 144, 146 and underlying the pressure shaft 168, slightly rearward thereof, is a paper sensor arm 180 having a centrally attached probe 182. The leftmost end of the paper sensor arm 180 extends through the side frame 146 and operatively engages a microswitch 184. As to be further understood, the paper sensor arm 180 and microswitch 184 are operative to detect the presence or absence of sheets of paper 14 within the paper trays 10.

Provided within the opening 186 within the track 150 of the side frame 146 is a roller assembly 188 constructed of a bracket 190 and a roller 192 rotationally mounted about a vertical axis. The bracket 190 is pivotally mounted to the side frame 146 within the opening 186 such that the roller 192 extends into the track 150 by means of bias spring 194. A pair of spaced apart paper guide plates 196, 198 are arranged vertically extending transversely between the side frames 144, 146 to the rear of the pressure shafts 168, 168' to define a paper feed path therebetween from a lower paper tray 12, as more clearly shown in FIG. 14. The specific operation of the paper loading assembly 142 will be described hereinafter.

Figure 9:
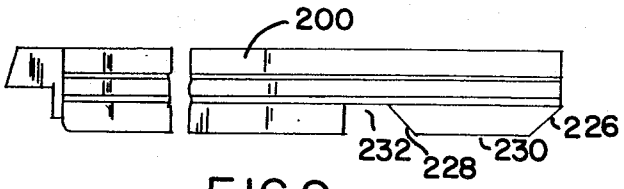
FIG. 9 is a side elevational view taken along lines 9—9 of FIG. 8 showing a leading side portion of the paper tray constructed of first, second and third cam surfaces.
Figure 8:
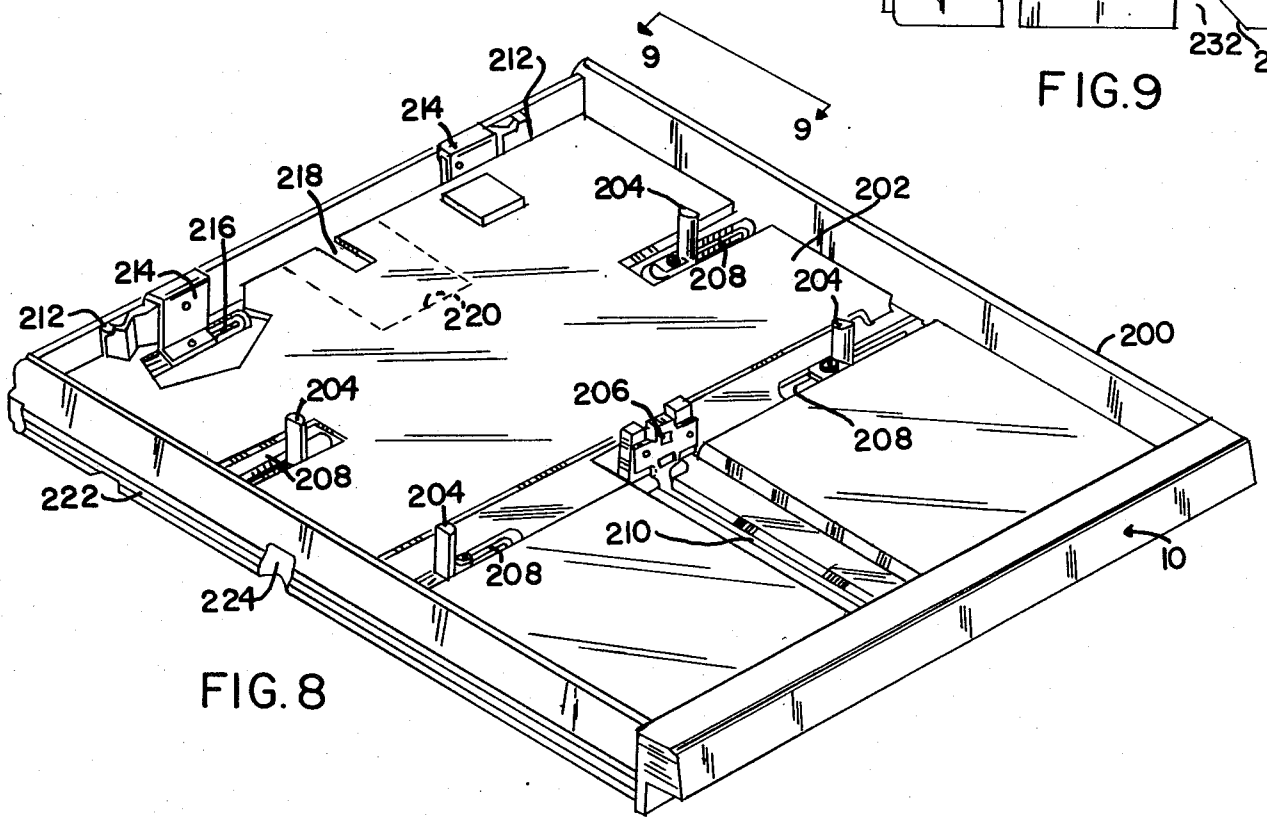
FIG. 8 is a perspective view of a paper tray in accordance with the present invention which is adapted to be inserted into the paper loading assembly as shown in FIG. 5*a;*

Turning to FIGS. 8 and 9, the construction of the paper trays 10, 12 will now be described. Initially, it is noted that the paper trays 10, 12 are of identical construction. In this regard, the paper trays 10, 12 are suitable for insertion in the paper loading assembly 142 between either the upper tracks 150 or lower tracks 152. This is further made possible by the identical construction of the paper loading assembly 142 operative for feeding of individual sheets of paper 14 from either the upper paper tray 10 or lower paper tray 12. As each of the paper trays 10, 12 is similarly constructed and supported between the side frames 144, 146 of the paper loading assembly 142, only the upper paper tray 10 and the manner of supporting same will be described.

The upper paper tray 10 comprises a tray shaped box member 200 having a paper support plate 202 pivotally supported in the bottom thereof. The dimensions of the tray shaped box member 200 are substantially greater than the dimensions of the paper 14 to be provided therein so as to accommodate sheets of paper of various widths and lengths. In this regard, the sheets of paper 14 are placed on the paper support plate 202 between a plurality of adjustable paper guides 204 and a paper stop 206. The paper guides 204 are adjustably secured within a slots 208 provided in the box member 200 to accommodate various widths of sheets of paper. Likewise, the paper stop 206 is adjustably positioned within a slot 210 to accommodate various lengths of sheets of paper to be used. As shown, each of the paper guides 204 and the paper stop 206 extends substantially above the surface of the paper support plate 202 to accommodate a stack of paper sheets. Also, suitable paper retention means may be provided for normally retaining the paper 14 in the paper tray 10 such as, for example, tab members 212 arranged at the forward side edges of the paper tray 10. These tab members 212 also serve to separate the sheets of paper 14 so that a single sheet of paper at a time will be fed by the pressure shaft 168 from the paper tray 10. The tab members 212 are adjustably spaced by means of a retaining lever 214 adjustably secured within an underlying slot 216 within the box member 200.

The forward end of the paper support plate 202 is provided with an opening 218 for receiving the probe 182 of the paper sensor arm 180 to be described hereinafter. Likewise, the forward end of the box member 200 is provided with an opening 220 to receive the pressure arm 170 of the pressure shaft 168 as to be described hereinafter. The left lateral edge of the box member 200 is provided with a longitudinally extending track 222 adapted to engage the roller 192 of the roller assembly 188 and a notch 224 positioned along the track for capturing the roller as to be described hereinafter. Referring to FIG. 9, there is shown the construction of the underlying portion of the forward end of the right lateral side of the box member 200. The forward end of the box member 200 is provided with a first sloped cam surface 226 and a second sloped cam surface 228 spaced apart by means of a horizontal cam surface 230. The second cam surface 228 extends into an opening 232 adapted to receive the roller 176 of the roller assembly 174 during installation of the paper tray 10 within the paper loading assembly 142.

Figure 10B:
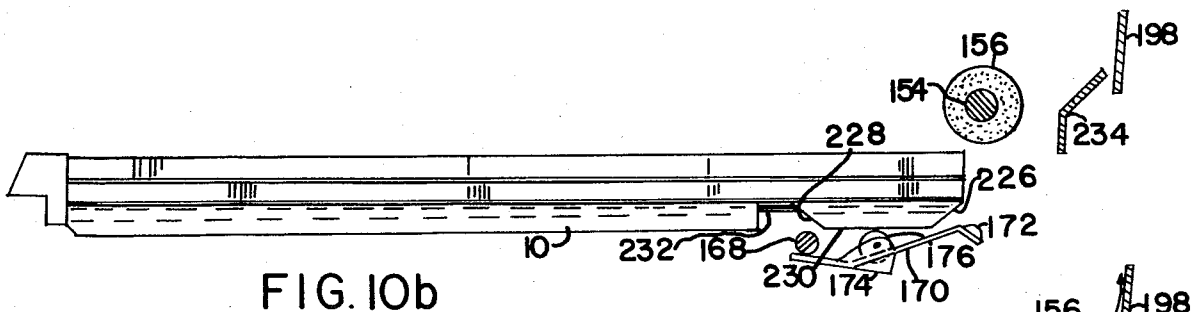
Figure 10C:
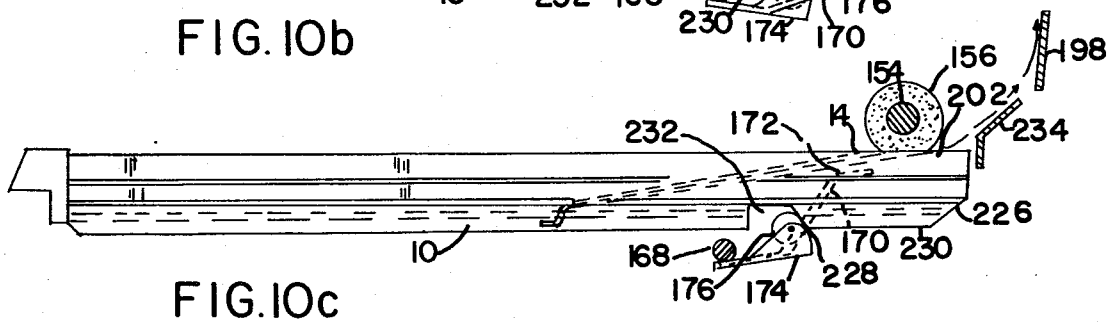

There will now be described the manner in which the paper trays 10, 12 are inserted into the paper loading assembly 142 with specific reference to FIGS. 10*a*–10*c*. Initially, a stack of sheets of paper 14 are positioned overlying the paper support plate 202 between the paper guides 204 and paper stop 206. The leading edge of the top sheet of paper 14 is positioned underlying the tab members 212 with the leading edge of the stack overlying the opening 218 within the paper support plate 202. The longitudinal center axis of the stack of paper 14 is now in alignment with the longitudinal center axis of the paper tray 10. The leading end of the paper tray 10 is inserted into the paper loading assembly 142 such that the sides of the paper tray are received within the tracks 150. As the paper tray 10 moves into the paper loading assembly 142, the roller 192 of the roller assembly 188 engages the track 222 provided on the left side of the paper tray. This engagement of the roller 192 with the track 222 urges the paper tray 10 towards the side frame 144 to ensure precise and repeated alignment of the paper 14 with the printing device 26 as the paper is fed from the tray 10. The extent to which the paper tray 10 may be inserted into the paper loading assembly 142 is limited by stops (not shown) on the side frame. In this regard, as the paper tray 10 is inserted within the paper loading assembly 142, the roller 192 rolls along the track 222 until it is captured within the notch 224, thereby detecting the tray 10 in its forwardmost position and biasing the tray 10 toward the right side frame. Thus, it can be appreciated that the position of the paper tray 10 within the paper loading assembly 142 is accurately repeatable thereby centering the paper with respect to the platen 32 to effect thereon by the printing device 26.

As shown in FIG. 10*a*, as the paper tray 10 is inserted into the paper loading assembly 142, the roller 176 attached to the bracket 174 of the pressure shaft 168 engages the first cam surface 226. The engagement of the roll 176 with the first cam surface 226 causes rotation of the pressure shaft 168 in a clockwise direction to pivot the pressure arm 170 away from interference with the leading edge of the paper tray 10. As shown in FIG. 10*b*, as the roller 176 engages the horizontal cam surface 230, the pressure arm 170 has been rotated to a position where the protrusion 172 of the pressure arm 170 is generally underlying the bottom of the paper tray 10. With the pressure arm 170 in the position illustrated in FIG. 10*b*, the paper tray 10 may be further inserted into the paper loading assembly 142 without interference from the pressure arm. Finally, as shown in FIG. 10*c*, as the roller 176 engages the second cam surface 228, the pressure arm 170 is rotated in a counterclockwise direction through the opening 220 provided in the bottom of the paper tray 10 so as to engage the leading edge of the paper support plate 220 by the protrusion 172. As the roller 176 is finally captured within the opening 232 adjacent the second cam surface 228, the pressure arm 170 is operative to pivot the paper support plate 202 upwardly to raise the forward edges of the sheets of paper 14 to be at or just above the forward end of the paper tray 10 and in contact with the rollers 156 for feeding individual sheets of paper therefrom along a paper feed path to the platen 32 to be printed thereon by the printing device 26. As shown, the leading end of the sheets of paper 14 are positioned adjacent a paper deflector plate 234 to deflect the paper fed from the paper tray 10 along the paper feed path formed between the paper guide plates 196, 198.

As should now be apparent, the paper tray 10 may be removed from the paper loading assembly 142 by reversing the above procedure. Specifically, as the paper tray 10 is withdrawn from the paper loading assembly 142, the roller 176 engages the second cam surface 228 to cause pivotal movement of the pressure arm 170 in a clockwise direction out of engagement with the paper support plate 202. When the roller 176 is engaged with the horizontal cam surface 230, as shown in FIG. 10*b*, the pressure arm 170 has been rotated outside the opening 220 of the tray 10 to permit removal of the paper tray from the paper loading assembly 142 with the roller 192 of the roller assembly 188 being urged out of the notch 224 and being guided along the track 222.

The paper loading assembly 142, as previously described, includes paper sensor arms 180, 180′ for sensing when the paper trays 10, 12 are out of paper. The paper sensor arms 180, 180′, one for the upper tray 10 and one for the lower tray 12, each include a probe 182, 182′ which is directed towards its respective paper tray 10, 12 and engages a sheet of paper 14 when paper is in the paper trays. The paper support plate 202 in the paper trays 10, 12 are each provided with an opening 218 therein in alignment with the probe 182, 182′ of the respective paper sensor arms 180, 180′. The microswitches 184, 184′ are respectively operatively connected to the paper sensor arms 180, 180′ and are opened when the probes 182, 182′ are raised and are closed when the probes are lowered, the probes being generally biased towards the lowered position. As long a sheet of paper 14 is in the paper trays 10, 12 on top of the paper support plate 202 which is biased upwardly by the pressure arms 170, 170′ the probes 182, 182′ will be in the raised position thereby opening the microswitches 184, 184′. However, when the last sheet of paper 14 is removed from the paper tray 10 or 12 or when the paper tray is removed from the paper loading assembly 142, there will be no sheet of paper or other means for maintaining the probes 182, 182′ in the raised position and the microswitches 184, 184′ will thus move into its lower position, thereby providing an indication that no paper is available for feeding to the printing device 26.

Figure 12:
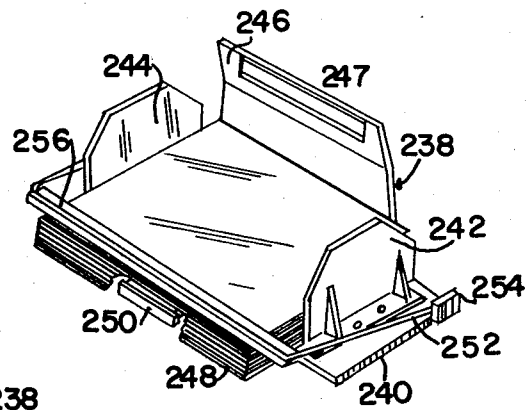
FIG. 12 is a perspective view of an envelope tray adapted for use in the envelope loading assembly as shown in FIG. 11.
Figure 11:
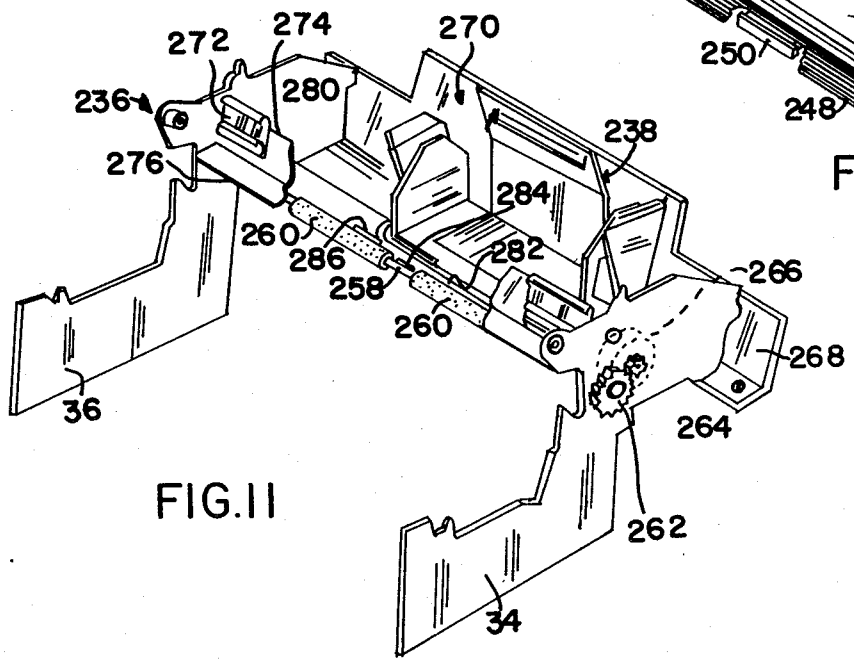
FIG. 11 is a perspective view of the envelope loading assembly in accordance with the present invention showing various components thereof.

Referring to FIGS. 11 and 12, the construction of the envelope feeding assembly or envelope stripper mechanism 236 and envelope tray 238 will now be described. Specifically with reference to FIG. 12, the envelope tray 238 is constructed from an envelope support plate 240 having a pair of spaced apart adjustable upstanding sidewalls 242, 244 and an upstanding rear wall 246 provided with an opening 247 to act as a handle for the envelope tray. A stack of envelopes 248 are supported by the envelope support plate 240 between the sidewalls 242, 244 which may be adjustable by suitable means such as slots provided within the envelope support plate in a similar manner to that previously described with respect to the paper trays 10, 12. The width of the paper support plate 240 is generally smaller than the width of the stack of envelopes 248. In this regard, the leading edge of the envelopes 248 overhangs the extent of the envelope support plate 240 as shown in FIG. 12. This overhanging portion of the envelopes 248 is centrally supported by a projection 250 extending outwardly from the envelope support plate 240. A U-shaped arm 252 is pivotally supported at its terminal ends by a block member 254 mounted to the rear corners of the envelope support plate 240. The front section of the arm 252 is aligned overlying the overhanging portion of the envelopes 248 and is provided with a weight 256 adapted to press the overhanging portion downwardly against the projection 250.

As shown in FIG. 11, the envelope stripper mechanism 236 includes an envelope feed shaft 258 transversely extending between the side plates 34, 36 and having a pair of spaced apart rollers 260 adapted for engagement with an envelope 248 within the envelope tray 238. The envelope feed shaft 258 is rotated by an envelope drive gear 262 meshed with drive gear 264 connected to a motor 266 adjacent the side plate 34. As shown in FIG. 14, the envelope feed shaft 258 is positioned underlying and rearward of the platen 32. A frame member 268 is provided transversely extending across the rear of the side plates 34, 36 to provide a well 270 between the frame member and the envelope feed shaft 258 adapted to receive the envelope tray 238 having a stack of envelopes 248 therein. As to be described with reference to FIG. 14, when the envelope tray 238 is placed within the well 270, the overhanging portion of the lowermost envelope 248 within the envelope tray is engaged by the rollers 260 of the envelope feed shaft 258. It can be appreciated that the rotation of the rollers 260 by the envelope feed shaft 258 is operative to withdraw the lowermost envelope 248 from the envelope tray 238 and to feed same along an envelope feed path to the platen 32. Also, it should be noted that as with the feeding mechanisms for the paper trays 10, 12, the envelope drive gear 262 is provided with a one-way roller clutch for uncoupling the envelope feed shaft 258 from rotation with the drive gear 262 so as to permit envelopes to be pulled from the envelope tray 238 by the platen 32, without interference from the envelope feed rollers 260, after an envelope has driven into engagement with the platen 32.

Forward of the envelope feed shaft 258 and transversely extending between the side plates 34, 36 is provided a pair of spaced apart paper guide plates 272, 274 defining a manual paper feed path therebetween in alignment with the rear portion of the platen 32. The lowermost portion of the paper guide plate 274 is provided with a generally horizontally extending stripping member 276 lying along one side of the envelope feed path with the rollers 260 of the envelope feed shaft 258 lying on the opposite side thereof. The envelope stripping member 276 is constructed of such material as natural rubbers and synthetic compounds such as urethane having a high coefficient of friction and, wherein the coefficient of friction between the stripping member and the envelope is greater than the coefficient of friction between two adjacent envelopes. The specific operation of the envelope stripping mechanism will be described hereinafter. Underlying the envelope feed shaft 258 and transversely extending between the side plates 34, 36 is a paper guide 280 adapted for supporting a lever actuated envelope microswitch 282, an envelope sensor 284 and a paper sensor 286. The envelope microswitch 282 is adapted to sense when the envelope tray 238 is out of envelopes. The lever of the envelope microswitch 282 engages the lowermost envelope 248 when an envelope is in the envelope tray 238 and the envelope tray is positioned within the well 270 as shown in FIG. 11. The envelope microswitch 282 is open in the absence of envelopes and closed when envelopes are present. As long as an envelope 248 is in the envelope tray 238 within the well 270 on top of the rollers 260 of the envelope feed shaft 268, the envelope microswitch 282 will be in the closed position. However, when the last envelope 248 is removed from the envelope tray 238, or when the envelope tray is removed from the well 270, there will be no envelope or other means for maintaining the envelope microswitch 282 in the closed position and will thus move into its open position, thereby providing an indication that no envelope 248 is available for feeding to the printing device 26.

Each of the sensors 62, 284, 286 are of the photoelectric reflective type which transmits a beam of light and which includes means for receiving the reflected light to close the sensors. Thus, when a sheet of paper 14 is moved in front of each of the sensors 62, 284, 286, the paper will serve to reflect and direct the projected light back to the sensors which detect same and closes the sensors indicating the presence of a sheet of paper. The paper sensor 286 is mounted in the lower end of the paper guide plate 280 facing towards the paper feed path formed between the paper guide plate 280 and spaced apart adjacent underlying paper guide plate 288. This sensor 286 serves to detect if and when a sheet of paper 14 is moved therepast in order to signal the actuation of the platen 32 for rotation to receive a sheet of paper fed from one of the paper trays 10, 12. Similarly, the envelope sensor 284 is attached to the paper guide plate 280 facing upward toward the envelope feed path adjacent the rollers 260 of the envelope feed shaft 258. This sensor 284 also serves to detect if and when an envelope 248 is moved therepast in order to signal the actuation of the platen 32 for rotation to receive an envelope fed from the envelope tray 238. The print head carriage assembly sensor 62 is located on top of the ribbon carriage 42 facing the platen 32 along the exit path of movement of a sheet of paper 14, or envelope 248, for detecting when a sheet of paper or envelope has been picked up by the platen and is being moved thereby along the paper exit path. This sensor 62 also serves to provide a reference point used in positioning of the print wheel 44 in a proper printing position relative to the paper 14. In this regard, the sensor 62 detects the leading edge, as well as the left edge, of a sheet of paper 14 or envelope 258 as it is fed to the platen 32 from a paper tray 10, 12 or envelope tray 238. Thus, the print wheel 44 may be positioned in proper alignment for typing on a sheet of paper 14 or envelope 248 having a predetermined top and left side margin. Further, the sensor 62 may be used to detect the bottom edge of a sheet of paper for determining the length of such sheet to ensure that the controls for the printing device have been preset for the proper size of paper contained within the printing trays 10, 12 or the size of the envelope 248 provided within the envelope tray 238.

The integrated printer and paper feeding apparatus 2 of the present invention has now been described with respect to its construction, as well as generally to its operation. The controlled operation of the integrated printer and paper feeding apparatus 2 will be performed by a computer or microprocessor contained within the housing 4 as is generally known to those skilled in the art. In this regard, the integrated printer and paper feeding apparatus 2 of the present invention may be programmed to operate by such a microprocessor in a variety of ways. For example, the method of operation of the integrated printer and paper feeding apparatus 2 of the present invention may be generally in accord with that disclosed in the foregoing U.S. Pat. No. 4,326,815, the subject matter of such patent being incorporated herein by reference. With this in mind, a brief description of the operation of integrated printer and paper feeding apparatus 2 in accordance with the preferred embodiment of the present invention will now be described.

Specifically referring to FIG. 14, a stack of sheets of paper 14 is positioned overlying the paper support plate 202 of the upper paper plate 10 and the lower paper plate 12. The uppermost sheet of each stack of paper 14 along the forward edge thereof is engaged under the tab members 212 as shown in FIG. 8. The paper trays 10, 12 are inserted into the paper loading assembly 142 between the tracks 150, 152 as previously described until the pressure arms 170, 170' tilt the paper support plates 202 to cause the upper sheets of paper 14 to be engaged by the rollers 156, 156' of the paper feed shafts 154, 154'. This is achieved by the roller 176 as shown in FIG. 6 engaging the first, second and horizontal cam surfaces 226, 228, 230 of the paper trays 10, 12. As shown in FIG. 14, the leading ends of the sheets of paper 14 within the paper trays 10, 12 are in alignment with the paper feed paths leading to the platen 32. For example, the sheets of paper 14 in the lower paper tray 12 are adjacent the paper deflector plate 234 for deflecting a sheet of paper fed therefrom along the paper feed path defined between the paper guide plates 196, 198. Likewise, the topmost sheet of paper 14 within the upper paper tray 10 is in alignment with the paper guide plate 196 for deflecting the sheet of paper fed therefrom along the paper feed path defined between the paper guide plates 280, 288 to the platen 32.

Where envelopes are desired to be printed upon, a stack of envelopes 248 are provided overlying the envelope support plate 240 and the weight 256 attached to the U-shaped arm 252 is positioned overlying the top envelope adjacent the leading edge of the stack of envelopes as they overhang the extent of the envelope support plate. The envelope tray 238 is inserted into the well 270 such that the overhanging edge of the bottom envelope engages the top circumferential surface of the rollers 260 of the envelope feed shaft 258. The leading edge of the envelopes 248 are positioned generally adjacent the rear surface of the paper guide plate 274. The bottom envelope 248 is now in line with the envelope feed path from the envelope tray 238 to the platen 32. As apparent, as envelopes 248 are fed from the bottom of the stack within the envelope tray 238, the weight 256 pivots downward by means of the U-shaped arm 252 to maintain a constant pressure on the lowermost envelope against the rollers 260 of the envelope feed shaft 258 for feeding same along the envelope feed path to the platen 32.

After the paper trays 10, 12 and envelope tray 238 are loaded into the integrated printer and paper feeding apparatus 2, the apparatus is powered up. At this time, the control panel 24 is used to control the functions of the integrated printer and paper feeding apparatus 2 in accordance with the present invention by means of a suitably programmed microprocessor or computer. In accordance with one embodiment, after powering up the integrated printer and paper feeding apparatus 2, the sector gear 100 is rotated in a clockwise direction by the drive gear 110 to cause engagement of the ejector roller 70 with the stationary ejector roller 72 for ejecting any paper 14 within the apparatus into the paper stacking tray 16. As the sector gear 100 rotates in the clockwise direction, the microswitch 120 is actuated by engagement of its lever with pin 118. The actuation of the microswitch 120 causes the sector gear 100 to be rotated in a counterclockwise direction by the drive gear 100 to its normal position as shown in FIG. 13*a* after any paper 14 has been ejected from the integrated printer and the paper feeding apparatus 2. Individual sheets of paper 14 are fed from one of the paper trays 10, 12 by rotation of the drive gear 162 (see FIG. 7) in either a clockwise or counterclockwise direction. As a sheet of paper 14 passes the paper sensor 286, the platen 32 is rotated after a short programmed time delay. When the print head carriage assembly sensor 62 then detects the leading edge of a sheet of paper 14, the sector gear 100 is rotated in a counterclockwise direction to disengage the paper bail 78 from engagement with the surface of the platen 32. The platen 32 is subsequently rotated a predetermined number of steps such that the leading edge of the sheet of paper 14 is positioned underlying the paper bail 78 and the sector gear 100 is rotated in the clockwise direction to cause the paper bail 78 to engage the platen 32 and secure the sheet of paper therebetween. The print head carriage assembly sensor 62 then detects the left edge of the sheet of paper and positions the print wheel 44 in its proper position for the start of typing to effect printing on the paper.

As the printing is effected on the paper 14, line-by-line, the platen 32 is indexed to roll the sheet of paper upward to accommodate the next line of printing. The printed sheet of paper follows along the paper exit path and is guided by the exit guide plate 84 towards the ejector roller 70 and stationary ejector roller 72. Upon receipt of an eject command or the detection of the trailing edge of a sheet of paper 14 by the print head carriage assembly sensor 62, the sector gear 100 is rotated by the drive gear 110 in a clockwise direction to cause the engagement of the ejector roller 70 with the stationary ejector roller 72 for ejecting the printed sheet of paper from therebetween and into the paper stacking tray 16. After the ejection of a sheet of paper 14 from the printing device 26, the sector gear 100 is rotated back to its normal position as shown in FIG. 13*a*. It is to be noted that the platen 32 is operative to smoothly advance a sheet of paper 14 along the paper feed path although the trailing edge of such paper is still engaged by the rollers 156, 156' of the paper feed shaft 154, 154'. This is achieved by the construction of the gears 158, 158' to include the roller clutch 160, 160' as previously described.

A further feature of the present invention is the provision of a manual paper feed path defined between the guide plates 272, 274 positioned upstanding behind the exit guide plate 84. The manual paper feed path is provided for the manual feeding of sheets of paper, envelopes, index cards and the like to the printing device 26 by engagement of same between the platen 32 and the pressure rollers 40 and 40'. The platen 32 can be manually indexed in a forward or reverse direction by use of the control panel 24 to effect feeding of such sheets of paper, envelopes, index cards and the like to the printing device 26. The integrated printer and paper feeding apparatus 2 permits the automatic or manual loading of sheets of paper 14 into the printing device 26 for printing thereon either from commands located in the text being processed or by operator selection through the control panel 24. Thus, in this latter regard, the integrated printer and paper feeding apparatus 2 may be used to feed individual sheets 14 of paper automatically to the printing device 26 and print any previously created text that is stored on a disk or in the word processing unit without any additional commands for controlling the operation of the apparatus.

As thus far described, at the paper receiving portion of the printing device 26, the paper 14 is guided between the platen 32 and the paper guide 38 having a plurality of pressure rollers 40 so that upon rotation of the platen, the paper will be advanced about the platen and move past the print wheel 44 so as to be in position for effecting printing thereon by movement of the print wheel transversely across the platen and by rotation of the platen to advance the paper for different lines of printing. In this regard, it will be noted that the paper 14 is positively fed by the rollers 156, 156' from the associated paper tray 10, 12 along the paper feed path to be received and moved by the platen 32. Once the paper 14 is received by the platen 32, the rotation of the paper feed shaft 154, 154' is stopped and the roller clutch 160, 160' in the gears 158, 158' allows the platen 32 to easily pull the paper from the paper tray 10, 12 to advance the paper past the print wheel 44 and the printing device 26. In this regard, once the paper 14 is in the print position for printing, the platen 32 may be advanced and moved in accordance with the normal printing instructions or commands for the printing device 26 for effecting printing on the paper. As to be further understood, it will be appreciated that during the printing operation, the trailing edge of the paper 14, which in some instances may be in the paper feed path, is free to move back and forth along this path without interference from the paper trays 10, 12 or rollers 156, 156' of the paper feed shafts 154, 154'. This is a most important feature, since in impact type printing operations, the paper 14 must be capable of moving back and forth by the platen 32 for the printing of subscripts, superscripts, charts or other special operations. Also, with the integrated printer and paper feeding apparatus 2, the paper 14 is moved backwards to align the leading edge with the print head carriage assembly sensor 62 and then further to sense the desired top margin.

As further shown in FIG. 14, the envelope tray 238 is positioned within the well 270 to the right of the guide plate 274 such that the leading edge of the lowermost envelope 248 is maintained in engagement with the rollers 260 of the envelope feed shaft 258. A constant pressing force is applied to the top of the stack of envelopes 248 by the weight 256 to insure positive engagement between the lowermost envelope 248 and the rollers 260. Activation of the motor 266 causes rotation of the rollers 260 in a counterclockwise direction to feed the bottommost enveloper 248 from the stack thereof along the envelope feed path to the platen 32. When the lowermost envelope 248 is fed from the stack thereof within the envelope tray 238, there is a tendency for the two lowermost envelopes to be pulled outward from the stack by the rollers 260. If this should occur, the topmost envelope 248 will be engaged by the stripping member 276 positioned adjacent the envelope feed path on the opposite side of the rollers 260. As the topmost envelope is engaged by the stripping member 276, the coefficient of friction between the stripping member and the envelope is greater than the coefficient of friction between the upper envelope and the lower envelope. As a result of this greater coefficient of friction, the rollers 260 of the envelope feed shaft 258 are operative to continue the movement of the lowermost envelope 248 along the envelope feed path while the upper envelope is retained by the stripping member 276. After the lowermost envelope 248 is fed along the envelope feed path to the platen 32, the upper envelope now is in engagement with the stripping member 276 and may be fed upon actuation of the rollers 260 in a manner as thus far described. Thus, the stripping member 276 prevents the inadvertent feeding of two envelopes 248 to the platen 32 along the envelope feed path upon rotation of the rollers 260 by the envelope feed shaft 258. As the envelopes 248 are fed from the envelope tray 238, the weight 256 is continuously rotated downward by means of the U-shaped arm 252 thereby insuring positive engagement of the lowermost envelope with the rollers 260.

As thus far described, the apparatus of the present invention is enclosed within a simple housing having sound reducing material provided to reduce the operational noise of the apparatus. The housing is designed to provide openings to conveniently receive the paper trays and envelope tray without having to remove the housing, as well as providing a top liftable cover for easy access to the components of the apparatus without having to remove the housing.

Although the invention herein has been described with reference to particular embodiments, it is to be understood that these embodiments are merely illustrative of the principles and application of the present invention. It is therefore to be understood that numerous modifications may be made in the illustrative embodiments in that other arrangements may be devised without departing from the spirit and scope of the present invention as defined by the appended claims.

What is claimed is:

1. A paper loading assembly for a printing device, said printing device including paper advancing means for advancing a sheet of paper within said printing device, said paper loading assembly comprising:

paper storing means for storing a plurality of individual sheets of paper, said paper storing means being insertable into and withdrawable from said printing device and having first and second spaced cam surfaces thereon; paper feeding means for feeding individual sheets of paper from said paper storing means along a paper feed path to said paper advancing means when said paper storing means has been inserted into said printing device;

engaging means movable between an operative position and an inoperative position, said engaging means being biased toward said operative position so as to be engageable with said paper storing means when said paper storing means has been inserted into said printing device to position the plurality of individual sheets of paper within said paper storing means into a position for feeding at least one of said individual sheets by said paper feeding means along said paper feed path, and said engaging means being movable to said inoperative position to permit said paper storing means to be inserted into and withdrawn from said printing device; and a cam follower member engageable with said first and second cam surfaces on said paper storing means for controlling the positioning of said engaging means during insertion and withdrawal of said paper storing means relative to said printing device, said cam follower member and said first and second cam surfaces on said paper storing means being so arranged that said cam follower member engages said first cam surface upon initial insertion of said paper storing means into said printing device to move said engaging means from said operative position to said inoperative position and thereafter engages said second cam surface upon further insertion of said paper storing means within said printing device to permit said engaging means to return to said operative position and into engagement with said paper storing means when insertion of said paper storing means into said printing device has been completed, and so arranged that said cam follower member engages said second cam surface upon initial withdrawal of said paper storing means from said printing device to move said engaging means from said operative position to said inoperative position and thereafter engages said first cam surface upon further withdrawal of said paper storing means from said printing device to premit said engaging means to return to said operative position when withdrawal of said paper storing means from said printing device has been completed, whereby said engaging means is automatically moved to said inoperative position upon initial insertion or initial withdrawal of said paper storing means relative to said printing device and automatically returned to said operative position after said paper storing means has been inserted into or withdrawn from said printing device.

2. The paper loading assembly of claim 1 wherein said paper storing means includes a base having an opening at one end thereof and a paper support plate overlying said base and tiltable between a paper feeding position and a paper storing position.

3. The paper loading assembly of claim 2 wherein said engaging means comprises a rod transversely extending relative to the paper feed path and having an upwardly extending member secured thereto for engaging said paper support plate through said opening.

4. The paper loading assembly of claim 3 wherein said cam follower member comprises a roller having an axis of rotation spaced from the longitudinal axis of said transversely extending rod and journaled to a bracket connected to said rod.

5. The paper loading assembly of claim 1 wherein said first and second cam surfaces are arranged underlying a lateral edge of said paper storing means at said one end thereof.

6. The paper loading assembly of claim 1, wherein said paper storing means includes a third cam surface arranged between said first and second cam surfaces and engageable by said cam follower member during insertion into and withdrawal of said paper storing means from said printing device, said third cam surface being arranged so that said cam follower member maintains said engaging means in said inoperative position when said cam follower member is in engagement with said third cam surface.

7. The paper loading assembly of claim 1 wherein said paper storing means includes adjustable paper locating means for defining an area therein of variable size for receiving stacks of paper of different sizes.

8. The paper loading assembly of claim 1 further including a housing lateral tracks for receiving the lateral edges of said paper storing means upon insertion of said paper storing means within said printing device.

9. The paper loading assembly of claim 8 wherein said housing includes positioning means arranged within one of said tracks for positioning said paper storing means adjacent the other of said tracks.

10. The paper loading assembly of claim 9 wherein said positioning means comprises a roller arranged to engage an outwardly facing groove provided along one lateral edge of said paper storing means.

11. The paper loading assembly of claim 10 wherein said outwardly facing groove includes a notch adapted to receive said roller therein to limit the permissible extent of insertion of said paper storing means within said printing device.

12. A paper loading assembly for a printing device, said printing device including printing means for printing on a sheet of paper and paper advancing means for advancing a sheet of paper within said printing device past said printing means to effect printing thereon, said paper loading assembly comprising:

paper storing means for storing a plurality of individual sheets of paper, said paper storing means being insertable into and withdrawable from said printing device, and said paper storing means having first and second cam surfaces thereon and a tiltable paper support plate, said paper support plate being normally positioned in a paper storing position and tiltable to a paper feeding position;

paper feeding means for feeding individual sheets of paper from said paper storing means along a paper feed path to said paper advancing means when said paper storing means has been inserted into said printing device and said paper support plate is arranged in said paper feeding position;

engaging means movable between an operative position and an inoperative position, said engaging means being biased toward said operative position so as to be engageable with said paper support plate when said paper storing means has been inserted into said printing device to position said paper support plate in said paper feeding position, and said engaging means being movable to said inoperative position out of engagement with said paper support plate to permit said paper storing means to be inserted into and withdrawn from said printing device without interference from said engaging means; and a cam follower member associated with said engaging means and engageable with said first and second cam surfaces on said paper storing means for controlling the positioning of said engaging means during insertion and withdrawal of said paper storing means relative to said printing device, said cam follower member and said first and second cam surfaces on said paper storing means being so arranged that said cam follower member engages said first cam surface upon initial insertion of said paper storing means into said printing device to move said engaging means from said operative position to said inoperative position and thereafter engages said second cam surface upon further insertion of said paper storing means within said printing device to permit said engaging means to return to said operative position and into engagement with said paper support plate to tilt said paper support plate into said paper feeding position when insertion of said paper storing means into said printing device has been completed, and so arranged that said cam follower member engages said second cam surface upon initial withdrawal of said paper storing means from said printing device to move said engaging means from said operative position to said inoperative position and thereafter engages said first cam surface upon further withdrawal of said paper storing means from said printing device to permit said engaging means to return to said operative position when withdrawal of said paper storing means from said printing device has been completed, whereby said engaging means is automatically moved to said inoperative position upon initial insertion or initial withdrawal of said paper storing means relative to said printing device and automatically returned to said operative position after said paper storing means has been inserted into or withdrawn from said printing device.

13. The paper loading assembly of claim 12 wherein said paper storing means includes a base underlying said paper support plate and having an opening at one end thereof.

14. The paper loading assembly of claim 13 wherein said engaging means comprises a rod transversely extending relative to the paper feed path and having an upwardly extending member secured thereto for engaging said paper support plate through said opening.

15. The paper loading assembly of claim 14 wherein said cam follower member comprises a roller having an axis of rotation spaced from the longitudianl axis of said transversely extending rod and journaled to a bracket connected to said rod.

16. The paper loading assembly of claim 12 wherein said first and second cam surfaces are arranged underlying a lateral edge of said paper storing means at said one end thereof.

17. The paper loading assembly of claim 12, wherein said paper storing means includes a third cam surface arranged between said first and second cam surfaces and engageable by said cam follower member during insertion into and withdrawal of said paper storing means from said printing device, said third cam surface being arranged so that said cam follower member maintains said engaging means in said inoperative position when said cam follower member is in engagement with said third cam surface.

18. The paper loading assembly of claim 12 wherein said paper storing means comprises a tray having adjustable paper locating means for defining an area therein of variable size for receiving stacks of paper of different sizes.

19. The paper loading assembly of claim 12 further including a housing having lateral tracks for receiving the lateral edges of said paper storing means upon insertion of said paper storing means within said printing device.

20. The paper loading assembly of claim 19 wherein said housing includes positioning means arranged within one of said tracks for positioning said paper storing means adjacent the other of said tracks.

21. The paper loading assembly of claim 20 wherein said position means comprises a roller arranged to engage an outwardly facing groove provided along one lateral edge of said paper storing means.

22. A printing device comprising:

a printing device housing;

paper advancing means for advancing a sheet of paper along a paper feed path within said printing device housing;

printing means for printing on a sheet of paper being advanced along said paper feed path by said paper advancing means;

paper storing means for storing a plurality of individual sheets of paper, said paper storing means being insertable into and withdrawable from said printing device housing, and said paper storing means having first and second spaced cam surfaces thereon;

paper feeding means for feeding individual sheets of paper from said paper storing means to said paper advancing means when said paper storing means has been inserted into said printing device housing;

engaging means movable between an operative position and an inoperative position, said engaging means being biased toward said operative position so as to be engageable with said paper storing means when said paper storing means has been inserted into said printing device housing to position the plurality of individual sheets of paper within said paper storing means into a position for said paper feeding means to feed at least one of said individual sheets to said paper advancing means, and said engaging means being movable to said inoperative position to permit said paper storing means to be inserted into and withdrawn from said printing device housing and a cam follower member engageable with said first and second cam surfaces on said paper storing means for controlling the positioning of said engaging means during insertion and withdrawal of said paper storing means relative to said printing device housing, said cam follower member and said first and second cam surfaces of said paper storing means being so arranged that said cam follower member engages said first cam surface upon initial insertion of said paper storing means into said printing device housing to move said engaging means from said operative position to said inoperative position and thereafter engages said second cam surface upon further insertion of said paper storing means within said printing device housing to permit said engaging means to return to said operative position and into engagement with said paper storing means when insertion of said paper storing means into said printing device housing has been completed, and so arranged that said cam follower member engages said second cam surface upon initial withdrawal of said paper storing means from said printing device housing to move said engaging means from said operative position to said inoperative position and thereafter engages said first cam surface upon further withdrawal of said paper storing means from said printing device housing to permit said engaging means to return to said operative position when withdrawal of said paper storing means from said printing device housing has been completed, whereby said engaging means is automatically moved to said inoperative position upon initial insertion or initial withdrawal of said paper storing means relative to said printing device housing and automatically returned to said operative position after said paper storing means has been inserted into or withdrawn from said printing device housing.

* * * * *